US010614789B2

(12) United States Patent
Redfern et al.

(10) Patent No.: US 10,614,789 B2
(45) Date of Patent: Apr. 7, 2020

(54) APPARATUS AND METHOD FOR PRIVACY ENHANCEMENT

(71) Applicant: JAGUAR LAND ROVER LIMITED, Coventry, Warwickshire (GB)

(72) Inventors: Luke Redfern, Warwickshire (GB); Kudzayi Chiwoko, Warwickshire (GB)

(73) Assignee: JAGUAR LAND ROVER LIMITED, Warwickshire (GB)

( * ) Notice: Subject to any disclaimer, the term of this patent is extended or adjusted under 35 U.S.C. 154(b) by 0 days.

(21) Appl. No.: 15/981,512

(22) Filed: May 16, 2018

(65) Prior Publication Data

US 2018/0336876 A1 Nov. 22, 2018

(30) Foreign Application Priority Data

May 17, 2017 (GB) ..... 1707901.3

(51) Int. Cl.
*G10K 11/175* (2006.01)

(52) U.S. Cl.
CPC .... *G10K 11/175* (2013.01); *G10K 2210/1282* (2013.01)

(58) Field of Classification Search
CPC ..... G10K 11/175; G10K 2210/1282
USPC ..... 381/73.1
See application file for complete search history.

(56) References Cited

U.S. PATENT DOCUMENTS 4,914,706 A 4/1990 Krause
2010/0158263 A1* 6/2010 Katzer ..... G10K 11/175 381/73.1

FOREIGN PATENT DOCUMENTS

DE 689 24 056 T2 11/1989

OTHER PUBLICATIONS

Search and Examination Report, GB1707901.3, dated Oct. 24, 2017.

* cited by examiner

*Primary Examiner* — Vivian C Chin
*Assistant Examiner* — Douglas J Suthers
(74) *Attorney, Agent, or Firm* — Miller Nash Graham & Dunn LLP

(57) ABSTRACT

Disclosed is a method of generating a sound masking signal, comprising: receiving an input sound signal, determining the frequency domain spectrum of the input sound signal, and generating a sound masking signal for the sound signal. The sound masking signal is generated from components comprising, i) a nominal component having a frequency domain spectrum the frequency band amplitudes of which are proportional to corresponding frequency band amplitudes of the input sound signal frequency domain spectrum, and ii) a decay biasing component that reduces the rate of at least some reductions in time domain amplitude of the sound masking signal where such reductions would be generated over time in accordance with the nominal component.

19 Claims, 4 Drawing Sheets

APPARATUS AND METHOD FOR PRIVACY ENHANCEMENT

CROSS REFERENCE TO RELATED APPLICATION

This application claims priority to and the benefit of Great Britain Patent Application No. 1707901.3 filed May 17, 2017, the content of which is incorporated herein by reference in its entirety.

TECHNICAL FIELD

The present disclosure relates to an apparatus and method for privacy enhancement. Aspects of the invention relate to a method of generating a sound masking signal, a system, a vehicle, a controller, a computer program, a non-transitory computer readable storage medium and a signal comprising computer readable instructions.

BACKGROUND

For convenience the background below is provided in the context of vehicle occupants. This is not however intended to be limiting and it will be appreciated that further examples could be offered from other fields where achieving privacy may be desirable but challenging (e.g. a shared work or social space). Furthermore it will be appreciated that the disclosures made in this application may be equally applicable to such alternative fields.

It is sometimes desired to provide privacy between occupants of a vehicle. For example when an occupant of the vehicle wishes to make a telephone call it may be preferred, by that occupant at least, that the call be private. Even where the occupant making the call uses headphones or the like, their speech may still be heard by other occupants of the vehicle. It has been known to provide a physical barrier in vehicles, such as between front and rear seat occupants of the vehicle. However this is intrusive and at least partly separates the occupants at all times, even when the barrier may be partly removed, such as lowered. Alternatively, a volume of an audio output from an in-vehicle entertainment system may be increased to obscure the speech, but this may be undesirable for both the occupant making the call and the other occupants.

It is an object of embodiments of the invention to at least mitigate one or more of the problems of the prior art.

SUMMARY

Aspects and embodiments of the invention provide a method of generating a sound masking signal, a system, a vehicle, a controller, a computer program, a non-transitory computer readable storage medium and a signal comprising computer readable instructions as claimed in the appended claims.

According to an aspect of the invention there is provided a method of generating a sound masking signal, the method comprising:

receiving an input sound signal;

determining the frequency domain spectrum of the input sound signal; and generating a sound masking signal for the input sound signal, the sound masking signal being generated from components comprising:

i) a nominal component having a frequency domain spectrum that is proportional to the frequency domain spectrum of the input sound signal, and ii) a decay biasing component that reduces the rate of one or more reductions in time domain amplitude of the sound masking signal.

According to another aspect of the invention there is provided a method of generating a sound masking signal, the method comprising:

receiving an input sound signal;

determining the frequency domain spectrum of the input sound signal; and generating a sound masking signal for the input sound signal, the sound masking signal being generated from components comprising:

i) a nominal component having a frequency domain spectrum having frequency band amplitudes which are proportional to corresponding frequency band amplitudes of the input sound signal frequency domain spectrum, and ii) a decay biasing component that reduces the rate of one or more reductions in time domain amplitude of the sound masking signal.

The contribution of the nominal component may mean that the sound masking signal substantively follows the input sound signal over time, in particular reflecting any increases in its time domain amplitude. This may mean that the sound masking signal is able to effectively mask the input sound signal. The decay biasing component may effectively adjust the nominal component to limit its following response to some drop offs in the time domain amplitude of the input sound signal. This may mean that masking sound generated in accordance with the sound masking signal may appear smoother and more pleasant to a listener, and may be considered to mimic natural sounds such as ocean waves. Additionally, a slower trailing off of the sound masking signal (as may be provided by the decay biasing component) may mean that it can effectively mask limited subsequent increases in the time domain amplitude of the input sound signal, with little or no interruption to the smooth decay in the time domain amplitude of the masking signal.

In some embodiments the decay biasing component reduces the rate of one or more reductions in time domain amplitude of the sound masking signal relative to corresponding reductions which would have been generated in accordance with the nominal component.

In some embodiments the method comprises constraining the rate of the time domain amplitude reduction to a predefined maximum gradient in dependence on the decay biasing component. As will be appreciated this predefined maximum gradient could be applied to all reductions in the time domain amplitude of the masking signal, or alternatively may be applied only to reductions from amplitudes above a threshold value.

In some embodiments, once the maximum gradient is invoked, a reduction at that gradient may be maintained unless and until an override criteria is met. Any one or more of the following override criteria may be used:

i) the reduction in the time domain amplitude of the sound masking signal as would be generated in accordance with the nominal component becomes less than the predefined maximum gradient;

ii) the time domain amplitude of the sound masking signal crosses a minimum amplitude difference threshold with respect to the time domain spectrum of the input sound signal;

iii) the time domain amplitude of the sound masking signal is reduced to substantially zero.

A reliable and steady reduction may appear smoother and may better mimic natural sounds such as ocean waves. Furthermore, such a steady reduction may mean that subsequent increases in the time domain amplitude of the input sound signal may be masked without the need for, or with only a more limited increase in the time domain amplitude of the sound masking signal. This may, for instance, mean that the remainder of a phrase or sentence constituting the sound signal is masked without apparent abrupt increases and/or decreases in the sound masking signal.

In some embodiments the predefined maximum gradient is selected so as a corresponding reduction in the time domain amplitude in accordance with the maximum gradient will occur over a duration substantially equal with an expected periodicity in the time domain amplitude of the input sound signal. Where for example the input sound signal is expected to be conversational speech, the predefined maximum gradient may be selected in accordance with an average or approximate average for phrase or sentence length in terms of duration during conversational speech.

In some embodiments the predefined maximum gradient of the rate of the time domain amplitude reduction comprises between 20 $dBs^{-1}$ and 40 $dBs^{-1}$. In some embodiments the predefined maximum gradient comprises between 25 $dBs^{-1}$ and 35 $dBs^{-1}$. In some embodiments the predefined maximum gradient comprises substantially 30 $dBs^{-1}$.

In some embodiments a proportionality relationship is defined between the nominal component and the input sound signal such that the corresponding frequencies in the frequency domain of the nominal component has a higher amplitude than in the input sound signal. This may increase the effectiveness of the masking of the sound signal. It may also increase the likelihood that the predefined maximum gradient can be maintained throughout subsequent increases in the time domain amplitude of the input sound signal. Such increases may for instance correspond to additional spoken words in completing a phrase or sentence.

In some embodiments the sound masking signal comprises a background component. The background component may for instance comprise a pre-recorded or computer generated sound. Inclusion within the sound masking signal of a background sound may mean that the sound masking signal is perceived as being more pleasing to a user. Furthermore, it may make changes in the time domain amplitude of other components of the sound masking signal less noticeable.

In some embodiments the background component comprises a naturally occurring sound. Such natural sounds may be more relaxing and agreeable to a user.

In some embodiments the background component comprises the sound of ocean waves and/or birds. Taking waves by way of example, the cyclical nature of the sound of waves may be conducive for blending with the time domain amplitude of the nominal component, which may be reflecting somewhat cyclical patterns in the input signal where it in turn is reflecting conversation speech.

In some embodiments the time domain amplitude of the background component is not dependent on the input sound signal. Thus, the background component may be substantially consistent and not linked to increases and decreases in the time domain amplitude of the input sound signal. This may mean that a user experiences a reduction in the amplitude difference between sound masking signal peaks and troughs and/or greater consistency in sound masking signal patterns. Nonetheless it will be appreciated that the time domain amplitude of the background component may still vary over time (e.g. as with the cyclical nature of the sound of waves).

In some embodiments the sound masking signal is generated from a ramp biasing component that constrains the rate of one or more increases in the time domain amplitude of the masking signal relative to corresponding increases which would have been generated in accordance with the nominal component. This may for instance be achieved by delaying the response to the input sound signal. The ramp biasing component may tend to reduce abrupt sound feature commencement within the sound masking signal which may be undesirable for user experience.

In some embodiments the rate of increase in the time domain amplitude of the masking signal is constrained in accordance with the ramp biasing component to a maximum between 100 $dBs^{-1}$ and 140 $dBs^{-1}$. In some embodiments the maximum is between 110 $dBs^{-1}$ and 130 $dBs^{-1}$. In some embodiments the maximum is substantially 120 $dBs^{-1}$.

In some embodiments the sound masking signal is generated from a low frequency enhancement component that increases the frequency domain amplitude of a proportion of the frequency domain spectrum of the sound masking signal that is below a threshold frequency by comparison with those amplitudes that would have been generated in accordance with the nominal component. Increasing the amplitude of lower frequencies may mean that the sound masking signal better mimics particular natural sounds (e.g. waves) and may therefore be perceived as more relaxing and/or may better blend with any background component used.

In some embodiments the frequency domain spectrum of the masking signal is smoothed. This may for instance be achieved by adjusting the amplitudes of the frequency bands in order that the difference in amplitude of adjacent frequency bands of the masking signal does not exceed a selected maximum. Significant peaks and troughs in this spectrum may sound unnatural to a user.

In some embodiments the frequency domain spectrum of the masking signal is smoothed by modelling a trace corresponding to the frequency domain spectrum of the masking signal and a trace corresponding to the input sound signal frequency domain spectrum as a physical system. In such embodiments the model may comprise a plurality of node pairs, each pair comprising a node on one trace and a node at a corresponding frequency on the other trace. The nodes may be modelled as being connected by springs. In some embodiments, the nodes of the trace of the frequency domain spectrum of the masking signal are modelled as masses biased with respect to the input sound signal frequency domain spectrum trace by the spring to which it is attached. The sound masking signal frequency domain spectrum trace is modelled as having at least a degree of flexibility so that it moves in accordance with the mass positions under the influence of the springs. One or more of various other forces acting on the physical system may also be modelled e.g. a gravity force, an inertia force, a friction force and a spectrum flex force for the trace of the frequency domain spectrum of the masking signal. As will be appreciated, the magnitude of each modelled force may be tailored in order to achieve a desired smoothing effect. The spectrum flex force could for example be altered to vary the rigidity of the trace of the sound masking signal frequency domain spectrum between and/or at the nodes.

In some embodiments the time domain spectrum of the masking signal is smoothed. This may be achieved by altering the time domain spectrum of the masking signal so that the rate of change in amplitude is maintained below a maximum threshold. This may reduce rapid changes in gradient, which may otherwise give rise to a stuttering effect in terms of user experience.

In some embodiments the method comprises sampling the input sound signal at a rate of at least 20 Hz. This may improve response and masking by comparison with alternative slower sampling systems.

In some embodiments the method comprises outputting the sound masking signal via one or more audio output devices.

In some embodiments the input sound signal comprises a signal indicative of speech.

According to a further aspect of the invention there is provided a sound masking system comprising:

at least one processor;

at least one memory comprising computer readable instructions;

the at least one processor being configured to read the computer readable instructions to cause performance of the method of either previous aspect.

In some embodiments the sound masking system comprises one or more audio output devices configured to output the generated sound masking signal.

In some embodiments the sound masking system comprises one or more audio capture devices configured to capture the input sound signal.

According to a still further aspect of the invention there is provided a vehicle comprising a sound masking system according to the previous aspect. The vehicle may comprise a road vehicle and/or a passenger vehicle and/or a car and/or a limousine.

In some embodiments the one or more audio output devices are provided in a first zone (optionally one occupant space) of the vehicle and the one or more audio capture devices are provided in a second zone (optionally another occupant space) of the vehicle.

According to a still further aspect of the invention there is provided a controller for generating a sound masking signal, the controller comprising:

an input for receiving an input sound signal;

a processing means for:

determining the frequency domain spectrum of the input sound signal; and generating a sound masking signal for the input sound signal; and an output for outputting the sound masking signal;

wherein the processing means is configured to generate the sound masking signal from components comprising:

i) a nominal component having a frequency domain spectrum having frequency band amplitudes which are proportional to corresponding frequency band amplitudes of the input sound signal frequency domain spectrum, and ii) a decay biasing component that reduces the rate of one or more reductions in time domain amplitude of the sound masking signal.

In some embodiments the decay biasing component reduces the rate of one or more reductions in time domain amplitude of the sound masking signal relative to corresponding reductions which would have been generated in accordance with the nominal component.

According to a still further aspect of the invention there is provided a computer program that, when read by a computer, causes performance of the method of either of the first two aspects.

According to a still further aspect of the invention there is provided a non-transitory computer readable storage medium comprising computer readable instructions that, when read by a computer, cause performance of the method of either of the first two aspects.

According to a still further aspect of the invention there is provided a signal comprising computer readable instructions that, when read by a computer, cause performance of the method of either of the first two aspects.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described by way of example only, with reference to the accompanying drawings, in which.

DETAILED DESCRIPTION OF THE EMBODIMENTS

Figure 1:
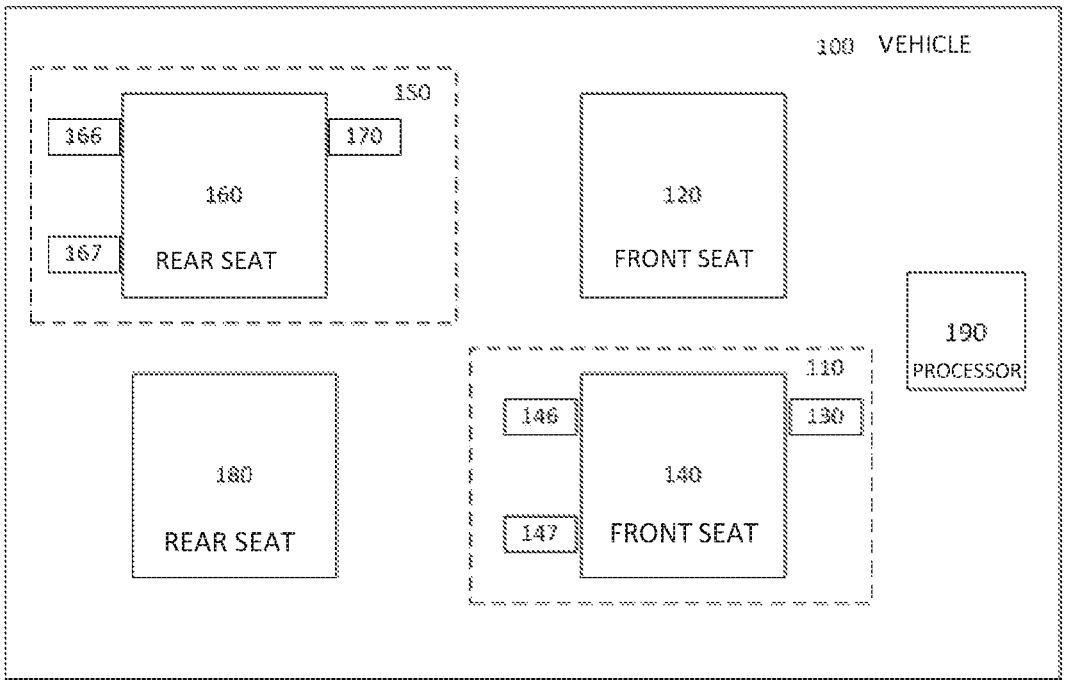
FIG. 1 shows a schematic view of a vehicle forming part of a sound masking system in accordance with an embodiment of the invention.

FIG. 1 schematically illustrates a vehicle 100 according to an embodiment of the invention. The vehicle 100 comprises a plurality of seating positions 120, 140, 160, 180. Four seating positions are illustrated, in a two-by-two arrangement, although it will be realised that this is merely an example and that other numbers of seating positions, such as five seating positions, and in other arrangements may be envisaged. Each seating position 120, 140, 160, 180 is associated with a respective seat for an occupant of the vehicle 100.

First and second seats 120, 140 are front seats of the vehicle 100 whilst third and fourth seats 160, 180 are rear seats of the vehicle 100. The second and third seats 140, 160 are shown as being associated each with a respective zone 110, 150 of the vehicle, which may be known as an infotainment zone or occupant space. Each zone of the vehicle may be a subset or portion of the interior of the vehicle 100. It is desired that audio content within one zone is insulated or contained within that zone. In particular, it is desired that audio content provided within one zone 150 is prevented from being intelligible within another zone 110.

As illustrated in FIG. 1, the vehicle 100 comprises two zones, namely a first zone 110 and second zone 150. The vehicle 100 may comprise other numbers of zones, such as three or four zones. However, description will be provided as an example with reference to the two illustrated zones, although the invention is not restricted in this respect. The first zone 110 is associated with a front-seat occupant of the vehicle 100, which may be a driver of the vehicle 100 in a right-hand drive configuration of vehicle 100. The second zone 150 is associated with a rear-seat occupant, hereinafter passenger, of the vehicle 100. In an example where the vehicle 100 is being driven by a driver such as a chauffeur, the rear-seat occupant may take (receive and make) calls whilst travelling in the vehicle 100, although the invention is not limited in this respect. The passenger may take the calls either using a handheld handset or via an in-car hands-free system of the vehicle 100, as will be explained. It is desired to prevent at least speech of the passenger being intelligible to the driver of the vehicle 100. It may also be desirable to prevent speech of another party on the call external to the vehicle 100 being intelligible to the driver. Whilst embodiments of the invention are explained with reference to the passenger and driver of the vehicle, it will be appreciated that the teachings of the invention may be applied between any two occupants of the vehicle in different zones. Furthermore it is desired to prevent speech being intelligible between occupants of different zones 110, 150 without a physical barrier or without excessive noise in the vehicle being generated.

The first zone 110 is associated with audio output devices 146, 147. The second zone is associated with audio output devices 166, 167. The audio output devices 146, 147, 166, 167 are arranged to output audio predominantly to an occupant of each respective zone 110, 150. The audio output devices 146, 147 of the first zone 110 are arranged, in use, for outputting different audio to the audio output devices 166, 167 of the second zone 150. In some embodiments, the audio output devices 146, 147, 166, 167 are arranged within a headrest of each seat 140, 160 to direct output audio toward the seat occupant's ears, thereby aiding audio isolation with each zone 110, 150. However, other mounting locations for the audio output means 146, 147, 166, 167 are envisaged such as within the seat body, or within or behind interior trim of the vehicle 100. The audio output devices 146, 147, 166, 167 may each be a speaker for outputting audible sounds based on received electrical signals, as will be appreciated.

In some embodiments, the first zone 110 is associated with an audio capture device 130. The audio capture device 130 is provided for outputting an electrical signal indicative of audio within the first zone 110. The audio capture device may be a first microphone 130. The first microphone may be used for determining audible characteristics of the first zone 110. In the illustrated embodiment, the second zone 150 comprises an audio capture device 170. The audio capture device 170 is provided for outputting an electrical signal indicative of audio within the second zone 150. The audio capture device may be a second microphone 170. The second microphone 170 may be used for facilitating the telephone call with the passenger within the second zone 150. In some embodiments the second microphone is used to determine one or more characteristics of speech within the second zone 150. The one or more characteristics may be a frequency profile and a volume of the speech within the second zone 150.

The vehicle 100 further comprises a processor 190. The processor 190 is communicably coupled to the microphones 130, 170 and the audio output devices 146, 147, 166, 167.

Figure 2:
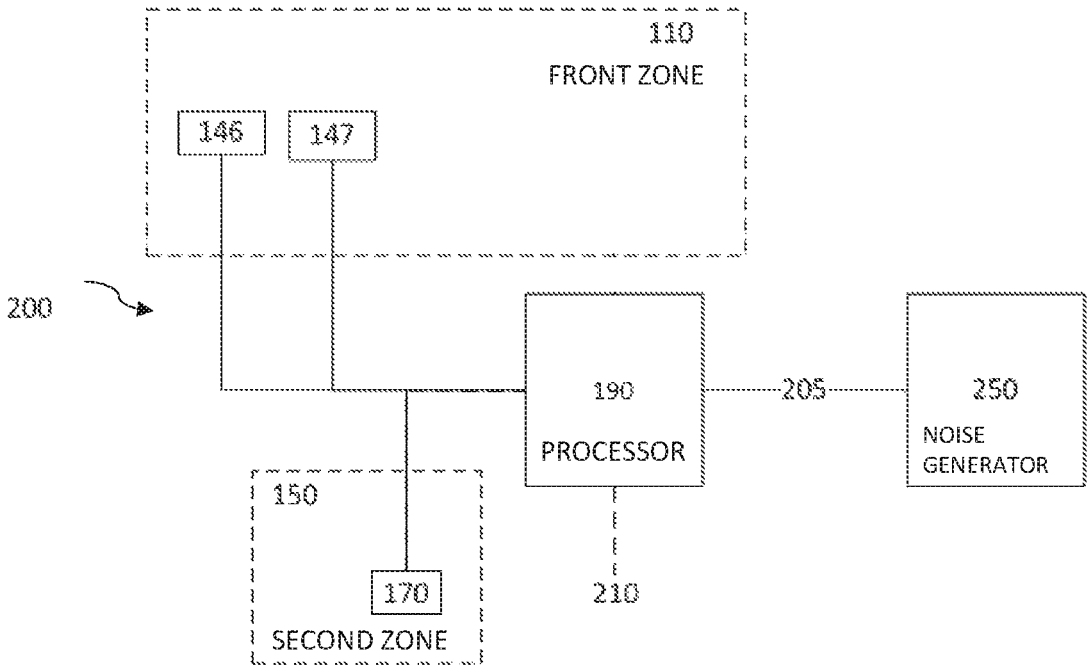
FIG. 2 shows a schematic view of a sound masking system in accordance with an embodiment of the invention.

FIG. 2 illustrates part of a sound masking system according to an embodiment of the invention. The system 200 comprises the processor 190. The system 200 is arranged to render unintelligible, at least partly, speech within the vehicle 100 outside of one or more zones within the vehicle 100.

The processor 190 is operative to execute computer software instructions stored in a memory accessible by the processor 190. The processor 190 is communicably coupled to a communication bus 210 of the vehicle 100 to exchange, i.e. to send and/or receive data, with other units or modules communicably coupled with the communication bus 210. The communication bus 210 may be implemented by, for example, a communication network such as one of CAN-Bus, Ethernet or Flexray, although other protocols may be envisaged.

The system 200 further comprises audio output means 146, 147 associated with at least one zone which, in the illustrated embodiment, is the first zone 110. It will be appreciated that the processor 190 may be associated with audio output means of more than one zone. The processor 190 is arranged to, in use, cause the audio output devices 146, 147 to output audible signals having one or more characteristics targeted to render speech originating in the second zone 150 at least partly unintelligible. The processor 190 comprises an output, in the form of an electrical output to the audio output devices 146, 147, which are both speakers.

In some embodiments, as noted above, the system further comprises second audio capture device 170 for providing a signal to the processor 190 indicative of audible signals in the second zone 150. The second audio capture device 170 is a microphone located within the second zone 150. The processor comprises an input means, such as an electrical input, for receiving an electrical signal from the second microphone 170.

The system further comprises a noise generator 250 for providing a noise signal 205 to the processor 190. The noise signal 205 may for example comprise a Brownian, white or pink noise signal. The noise generator 250 is coupled to the processor 190 by an electrical input for receiving the noise signal. In other embodiments, the noise signal 205 may be music from a radio or a streaming audio source. The noise generator 250 may be an entertainment system of the vehicle which is capable of receiving radio, digitally streamed music or audio (such as audiobooks), such as over the Internet, or reproducing stored audio for example from a CD, DVD, memory device or other storage medium.

Referring now to FIGS. 3 to 8 the manner in which the sound masking system 200 renders at least partly unintelligible speech originating within the second zone 150 to an occupant of the first zone 110 is discussed.

Figure 3:
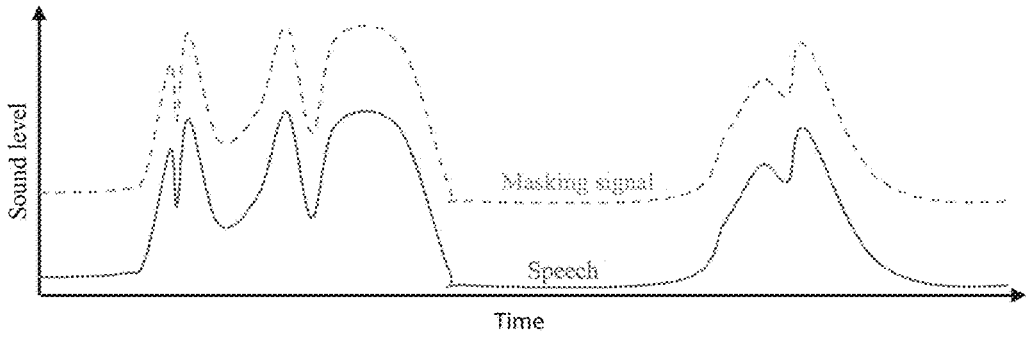
FIG. 3 shows a time domain graph for a sound signal input (speech) and a basic sound masking signal.

The basic principal employed is that of sound masking. This involves playback of noise to mask the input sound signal. As the input sound signal varies over time, so the sound masking signal is varied to suit. This tends to produce a sound masking signal having a time domain amplitude that has a linear dependence with the time domain amplitude for a contemporary sound input signal. Thus over time a plot of these amplitudes tend to have the same shape (as shown in FIG. 3). Additionally, it may be in some cases that the sound masking signal has a noise cancelling component. This would comprise near simultaneous playback of a recreation of the input sound signal at substantially 180° out of phase.

Figure 9:
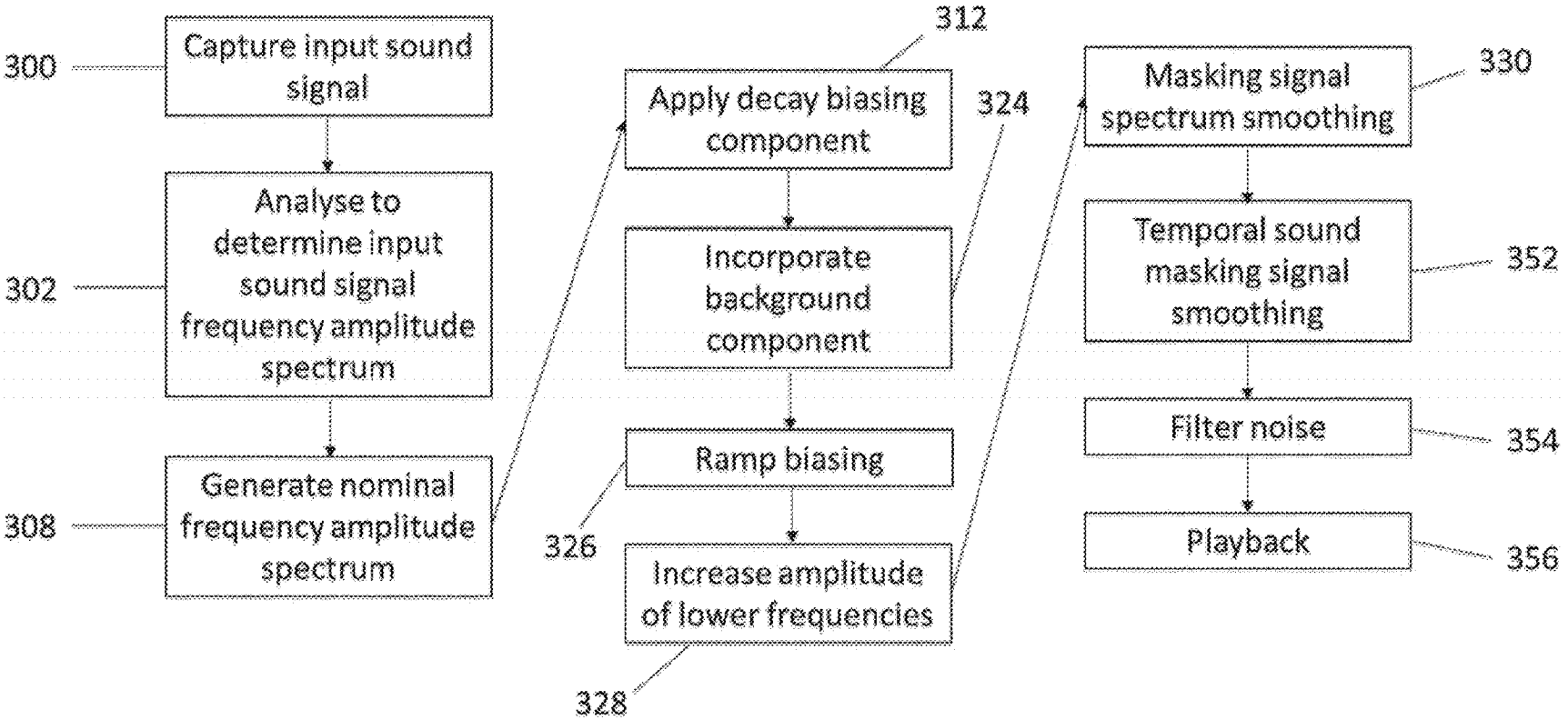
FIG. 9 shows a series of method steps in accordance with an embodiment of the invention.

Method steps undertaken in rendering at least partly unintelligible speech originating within the second zone 150 to an occupant of the first zone 110 are now discussed with reference to FIG. 9. In a capture step 300, the speech of an occupant of the second zone 150 is captured by the second microphone 170. The speech captured is converted to an input sound signal by the second microphone 170 and is sent to the processor 190. The processor 190 executes computer software instructions stored in the memory to perform the following steps.

Figure 4:
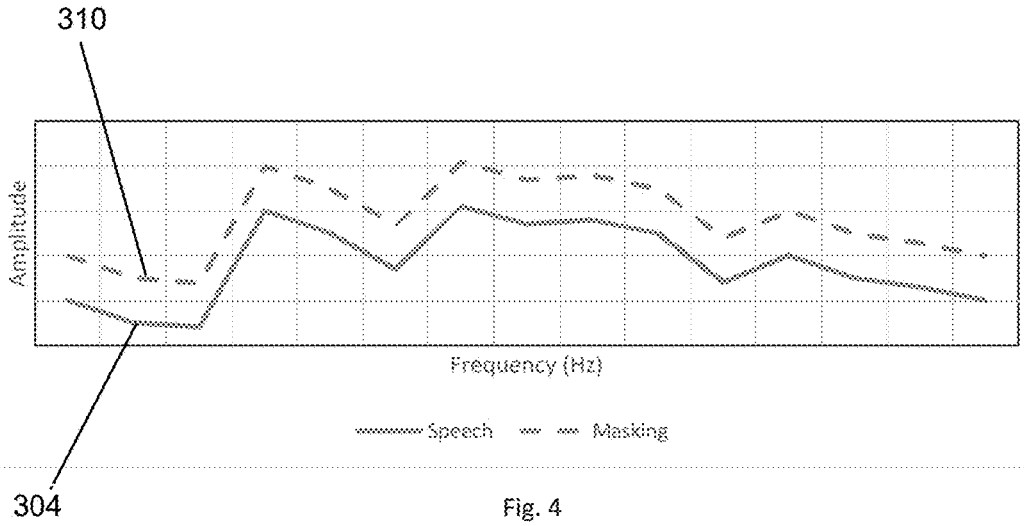
FIG. 4 shows a frequency domain graph for a sound signal input (speech) and a nominal component for a sound masking signal in accordance with an embodiment of the invention.
Figure 5:
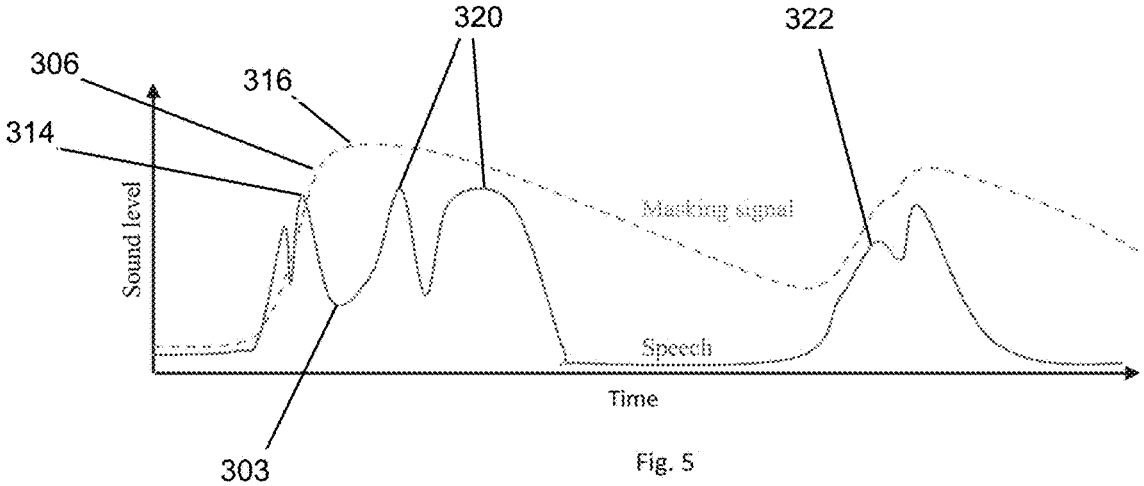
FIG. 5 shows a time domain graph for a sound signal input (speech) and a sound masking signal in accordance with an embodiment of the invention.

In an analysing step 302 the processor 190 analyses an input sound signal (a time domain trace 303 of which is shown as the "speech" trace in FIG. 5) to determine its frequency domain spectrum 304. The input sound signal frequency domain spectrum 304 is shown in FIG. 4. The processor 190 then generates a sound masking signal (a time domain trace 306 of which is shown in FIG. 5) for the input sound signal from components discussed further below.

A first component generated by the processor 190, in a nominal component generation step 308, is a nominal component. The frequency domain spectrum 310 of the nominal component is divided into frequency bands and is generated so that the amplitudes of these bands are directly proportional to corresponding amplitudes of the input sound signal frequency domain spectrum 304. More specifically in the example shown in FIG. 4, the amplitude of each frequency band of the nominal component frequency domain spectrum 310 is generated by increasing the corresponding frequency band amplitude of the input sound signal frequency domain spectrum 304 by a nominal amplitude. Consequently the trace of the nominal component frequency domain spectrum 310 has the same shape as the input sound signal frequency domain spectrum 304, but displaced into a higher amplitude regime.

A second component implemented by the processor 190 in generating the sound masking signal is a decay biasing component. The decay biasing component is implemented in a decay application step 312. The decay biasing component limits the rate of reductions over time in the time domain amplitude of the sound masking signal. It is set at a predefined maximum gradient in the sound masking signal time domain trace 306. The decay biasing component may therefore be considered as an adjustment to the time domain trace 306 of the sound masking signal that would otherwise be produced in accordance with the nominal component.

Additionally once the decay biasing component is invoked to limit a reduction over time in the time domain amplitude of the sound masking signal, that maximum reduction rate is maintained unless and until an override criteria is met. Thus the effect of the decay biasing component is that once the nominal component would give rise to an above maximum reduction over time in the time domain amplitude of the sound masking signal, the maximum reduction is instead invoked and thereafter maintained unless and until an override criteria is met.

The underlying effect of the decay biasing component can be seen in FIG. 5, where following an initial peak 314 in the time domain amplitude of the input sound signal, and a corresponding initial peak 316 in the time domain amplitude of the sound masking signal, the sound masking signal maintains a substantially consistent reduction over time for an extended period despite significant variation in the input sound signal amplitude over the same period. The gradient maintained in this period by the sound masking signal is not completely consistent, but this is due to the effect of subsequent smoothing of this signal.

In the present embodiment there are two override criteria, either one of which will override the default effect of the decay biasing component to maintain the maximum rate of reduction once reached. The first override criteria occurs where the time domain amplitude of the sound masking signal crosses a minimum amplitude difference threshold with respect to the time domain amplitude of the input sound signal. This effect can be seen in FIG. 5. Where subsequent peaks 320 in the time domain amplitude of the input sound signal produce no variation in the time domain amplitude reduction rate over time of the sound masking signal because the minimum amplitude difference threshold is not breached. A subsequent peak 322 does however override maintenance of the reduction rate because the threshold would be crossed otherwise.

The second override criteria occurs where the time domain amplitude of the masking signal is reduced to zero. In this case the reduction cannot be maintained.

As will be appreciated in other embodiments additional or alternative criteria may be employed. One example criteria is the reduction in the time domain amplitude of the sound masking signal as would be generated in accordance with the nominal component becomes less than the predefined maximum gradient.

The predefined maximum gradient is selected so as a corresponding reduction in the time domain amplitude in accordance with the maximum gradient will occur over a duration substantially equal with expected approximate periodicity in the time domain amplitude of the input sound signal. In this case the periodicity corresponds to expected sentence length, based on an approximate average for conversational speech. In this way the time domain amplitude of the sound masking signal may tend to reduce over the course of a spoken sentence captured in the input sound signal and into a gap before another sentence is commenced.

As will be appreciated, the generation of the nominal component so as its frequency domain is in a higher amplitude regime than the input sound signal frequency domain amplitude, may allow maintenance of a rate of reduction over time in the time domain amplitude of the sound masking signal (as directed by the decay biasing component) to be maintained for longer before an override criteria is invoked.

A third component incorporated by the processor 190 in generating the sound masking signal is a background component. The background component is incorporated in a background component incorporation step 324. The background component corresponds to a pre-recorded sound, in this case of ocean waves, however other pre-recorded sounds are envisaged. The time domain amplitude of the background component is not dependent on the input sound signal. It may therefore be that parts of the sound masking signal corresponding to the background component are maintained at a consistent level (e.g. consistent volume/amplitude). As will be appreciated, however, the frequency domain spectrum of the background component and/or its time domain amplitude may change over time (e.g. following natural variation in the sound components and level of the ocean waves).

A fourth component implemented by the processor 190 in generating the sound masking signal is a ramp biasing component. The ramp biasing component is implemented in a ramp application step 326. The ramp biasing component limits to a predefined maximum gradient increases in the time domain amplitude of the sound masking signal that would be generated over time in accordance with the nominal component. The decay biasing component may therefore be considered as an adjustment to the sound masking signal time domain trace 306 that would otherwise be produced in accordance with the nominal component. The underlying effect of the ramp biasing component can be seen in FIG. 5, where an increase over time in the time domain amplitude of the input sound signal to reach the initial peak 314 produces a lower gradient increase in the time domain amplitude of the sound masking signal. The shallower increase in the sound masking signal reflects the maximum gradient of the ramp biasing component having been exceeded in the time domain input sound signal trace 303 and nominal component, and the maximum gradient having therefore been invoked instead. As will be appreciated subsequent smoothing of the sound masking signal time domain trace accounts for the variation in the gradient even where the maximum gradient is invoked.

A fifth component implemented by the processor 190 in generating the sound masking signal is a low frequency enhancement component. The low frequency enhancement component is implemented in a low frequency enhancement step 328. The low frequency enhancement component increases the amplitude of a proportion of the frequencies in the sound masking signal frequency domain spectrum that are below a threshold frequency by comparison with the amplitudes of those frequencies that would have been generated in accordance with the nominal component. The amplitudes at these frequencies may be enhanced by for instance multiplying by a constant or by a ramp or other distribution. Increasing the amplitude of lower frequencies may mean that the sound masking signal better mimics particular natural sounds (e.g. ocean waves) and may therefore be perceived as more relaxing and/or may better blend with any background component used. As will be appreciated however, in other embodiments the amplitudes of an alternative selection of frequencies may be increased.

Figure 6:
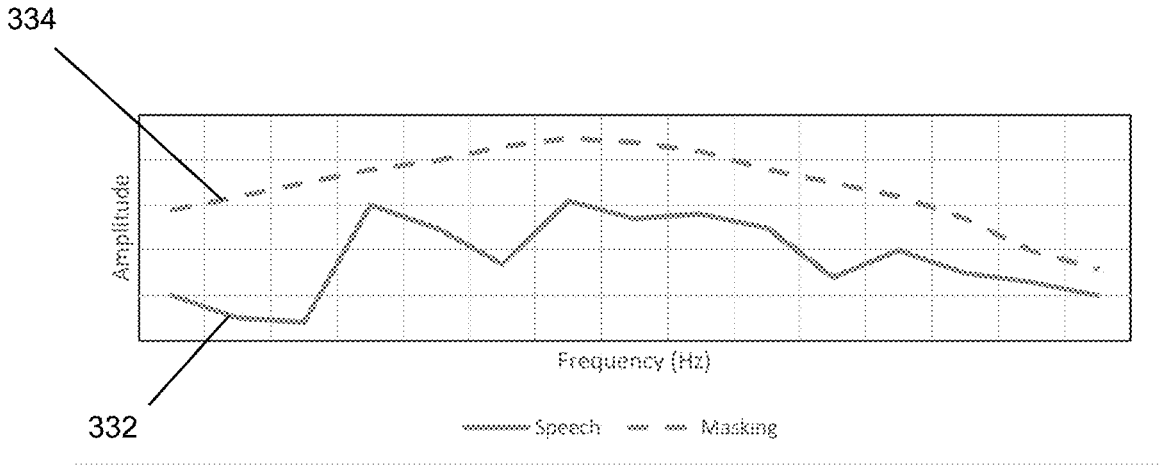
FIG. 6 shows a frequency domain graph for a sound signal input (speech) and a smoothed version of a nominal component for a sound masking signal in accordance with an embodiment of the invention.

In a spectrum smoothing step 330, the processor 190 smooths the frequency domain spectrum of the masking signal generated in accordance with the components previously discussed. An example input sound signal frequency domain spectrum 332 and corresponding smoothed sound masking signal frequency domain trace 334 is shown in FIG. 6. This smoothing may be performed in various ways.

Figure 7:
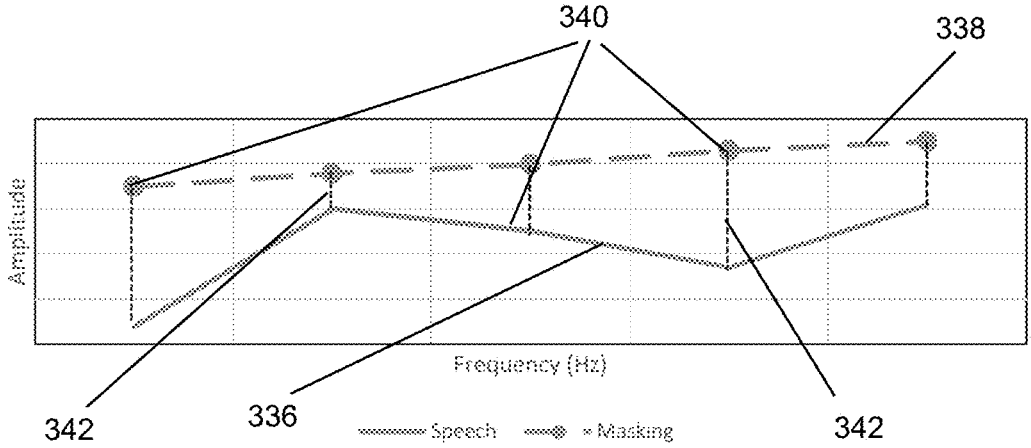
FIG. 7 shows a graphical representation of a model used to smooth a frequency domain nominal component for a sound masking signal in accordance with an embodiment of the invention.
Figure 8:
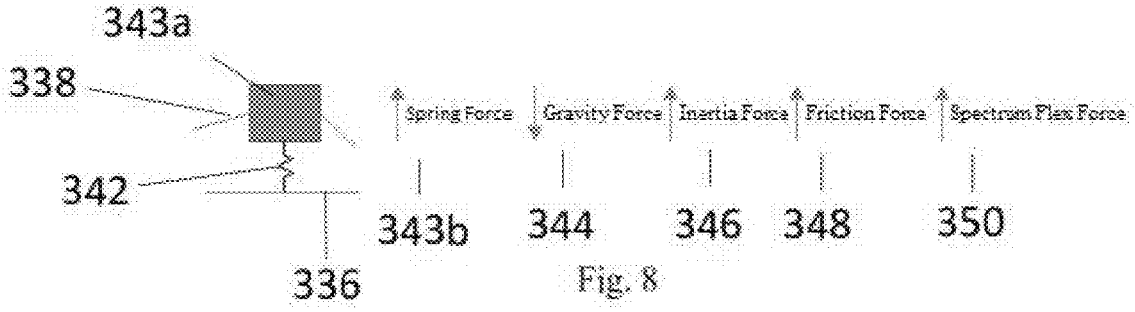
FIG. 8 shows a schematic of forces of a model used to smooth a frequency domain nominal component for a sound masking signal in accordance with an embodiment of the invention.

One smoothing method is discussed below with reference to FIGS. 7 and 8. In FIG. 7 an input sound signal frequency domain spectrum (speech) 336 and a smoothed sound masking signal frequency domain spectrum (masking) 338 are shown. In order to smooth a baseline sound masking signal frequency domain spectrum, a model is created whereby its trace and that of the input sound signal frequency domain spectrum 336 are modelled as being physically connected by springs 342 at corresponding frequency band nodes 340. The nodes on the baseline sound masking signal frequency domain spectrum are modelled as masses 343*a* and the springs 342 modelled as biasing the masses 343*a* with respect to the input sound signal frequency domain spectrum 336 with a spring force 343*b*. The baseline sound masking signal frequency domain spectrum is modelled as free to move in accordance with the modelling of the mass 343*a* positions under the influence of the springs 342 and the modelled application of various other forces illustrated in FIG. 8. The trace of the input sound signal frequency domain spectrum 336 is reproduced as it varies over time and is not re-positioned, distorted or otherwise affected by the spring forces 343*b* or any of the other forces discussed further below.

In the present example the additional forces are a gravity force 344, an inertia force 346, a friction force 348 and a spectrum flex force 350. The inertia force 346 models inertia of the masses 343*a* as their positions change (e.g. through application of the various forces and/or as the input sound signal frequency domain spectrum changes over time). The friction force 348 models frictional forces on the masses 343*a* as they change position. The spectrum flex force 350 models rigidity between and/or at the nodes 340 of the trace of the baseline sound masking signal frequency domain spectrum. In other embodiments however only one or some of these forces may be modelled and/or additional alternative forces may be modelled. As will be appreciated the magnitude of each modelled force may be tailored in order to achieve a desired smoothing effect. The spectrum flex force 350 could for example be altered to vary the rigidity of the trace of the baseline sound masking signal frequency domain spectrum between and/or at the nodes 340. The direction of the spring force 343*b*, inertia force 346, friction force 348 and spectrum flex force 350 depicted in FIG. 8 are illustrative only. The direction and magnitude of the force exerted by a spring 342 on its corresponding mass 343*a* will depend on the modelled distance of the mass 343*a* from the trace of the input sound signal frequency domain spectrum 336 at any given time. Similarly the direction and magnitude of the inertia force 346 will depend on the direction and velocity of mass 343*a* travel at the given time. The direction of the force exerted by friction will also depend on the direction and velocity of mass 343*a* travel at the given time. Finally the magnitude and direction of the force exerted on a mass 343*a* by the spectrum flex force will depend on the positions of the other masses 343*a* relative thereto at the given time.

A time domain smoothing step 352 is performed by the processor 190, which smooths the time domain trace of the sound masking signal 306.

Based on the generated sound masking signal the processor 190 then, in a filter step 354, filters the noise signal 205 generated by the noise generator 250. In a final playback step 356, the filtered noise signal is sent to the audio output devices 146 and 147.

In use, the method described above is continually repeated in real time, with the captured input sound signal and sound masking signal generated being constantly updated. The nominal component provides a basic sound masking tailored to masking the input sound signal at the particular time in question, and to which modifications can be made in accordance with the various additional steps discussed. The decay biasing component may give the time domain trace of the sound masking signal a smoother tail off following an amplitude peak in the input sound signal time domain trace. This may give the sound masking signal a smoother effect and may better match and blend with the background component, which may itself provide a more natural and agreeable masking effect. The ramp biasing component may tend to reduce abrupt sound feature commencement within the sound masking signal which may be undesirable for user experience. Furthermore, the low frequency enhancement component may mean that the sound masking signal better mimics natural sounds and may be more agreeable to a user. Finally the two smoothing steps may further reduce apparent discontinuities in the sound masking signal.

As will be appreciated, in other embodiments only some of the components and steps mentioned above may be performed. Additionally or alternatively the components and steps may be given any priority in a hierarchy such that components/steps higher in the hierarchy take precedence over those lower in the hierarchy in the event of disagreement between them.

It will be appreciated that embodiments of the present invention can be realised in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are embodiments of machine-readable storage that are suitable for storing a program or programs that, when executed, implement embodiments of the present invention. Accordingly, embodiments provide a program comprising code for implementing a system or method as claimed in any preceding claim and a machine readable storage storing such a program. Still further, embodiments of the present invention may be conveyed electronically via any medium such as a communication signal carried over a wired or wireless connection and embodiments suitably encompass the same.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed. The claims should not be construed to cover merely the foregoing embodiments, but also any embodiments which fall within the scope of the claims.

The invention claimed is:

1. A method of generating a sound masking signal, the method comprising:

receiving an input sound signal;

determining a frequency domain spectrum of the input sound signal;

generating a sound masking signal for the input sound signal, the sound masking signal being generated from components comprising:

i) a nominal component having a frequency domain spectrum, the frequency band amplitudes of which are proportional to corresponding frequency band amplitudes of the input sound signal frequency domain spectrum, and ii) a decay biasing component that reduces a rate of one or more reductions in a time domain amplitude of the sound masking signal; and constraining the rate of the one or more reductions in the time domain amplitude to a predefined maximum gradient based on the decay biasing component, the predefined maximum gradient being selected such that a corresponding reduction in the time domain amplitude in accordance with the maximum gradient will occur over a duration that is substantially equal with an expected periodicity in the time domain amplitude of the input sound signal.

2. A method according to claim 1, further comprising maintaining a reduction at the predefined maximum gradient unless and until an override criteria is met.

3. A method according to claim 2, wherein the override criteria comprise one or more of the following:

i) the reduction in the time domain amplitude of the sound masking signal as would be generated in accordance with the nominal component becomes less than the predefined maximum gradient;

ii) the time domain amplitude of the sound masking signal crosses a minimum amplitude difference threshold with respect to the time domain spectrum of the input sound signal; and iii) the time domain amplitude of the sound masking signal is reduced to zero.

4. A method according to claim 1, wherein the predefined maximum gradient of the rate of the time domain amplitude reduction comprises between 20 $dBs^{-1}$ and 40 $dBs^{-1}$.

5. A method according to claim 1, wherein a proportionality relationship is defined between the nominal component and the input sound signal such that corresponding frequencies in the frequency domain of the nominal component have a higher amplitude than that of the input sound signal.

6. A method according to claim 1, wherein the sound masking signal is generated from a ramp biasing component that constrains the rate of one or more increases in the time domain amplitude of the masking signal relative to corresponding increases which would have been generated in accordance with the nominal component; and optionally wherein the rate of increase in the time domain amplitude of the masking signal is constrained in accordance with the ramp biasing component to a maximum between 100 $dBs^{-1}$ and 140 $dBs^{-1}$.

7. A method according to claim 1, wherein the sound masking signal is generated from a low frequency enhancement component that increases the frequency domain amplitude of a proportion of the frequency domain spectrum of the sound masking signal that is below a threshold frequency by comparison with those amplitudes that would have been generated in accordance with the nominal component.

8. A method according to claim 1, wherein the frequency domain spectrum of the masking signal is smoothed; and/or wherein the time domain spectrum of the masking signal is smoothed.

9. A method according to claim 1, further comprising sampling the input sound signal at a rate of at least 20 Hz.

10. A method according to claim 1, further comprising outputting the sound masking signal via one or more audio output devices.

11. A method according to claim 1, wherein the input sound signal comprises a signal indicative of speech.

12. A method according to claim 1, wherein the sound masking signal comprises a background component.

13. A method according to claim 12, wherein the time domain amplitude of the background component is not dependent on the input sound signal.

14. A sound masking system, comprising:

at least one processor; and at least one memory comprising computer readable instructions, the at least one processor being configured to read the computer readable instructions to cause performance of the method of claim 1.

15. A sound masking system according to claim 14, further comprising one or more audio output devices configured to output the generated sound masking signal; and/or one or more audio capture devices configured to determine the input sound signal.

16. A vehicle comprising a sound masking system according to claim 14.

17. A controller for generating a sound masking signal, the controller comprising:

an input for receiving an input sound signal;

a processing means for:

determining a frequency domain spectrum of the input sound signal; and generating a sound masking signal for the input sound signal; and an output for outputting the sound masking signal, wherein the processing means is configured to generate the sound masking signal from components comprising:

i) a nominal component having a frequency domain spectrum having frequency band amplitudes which are proportional to corresponding frequency band amplitudes of the input sound signal frequency domain spectrum, and ii) a decay biasing component that reduces the rate of one or more reductions in time domain amplitude of the sound masking signal;

wherein the processing means is configured to constrain the rate of the one or more reductions in the time domain amplitude to a predefined maximum gradient based on the decay biasing component, the predefined maximum gradient being selected such that a corresponding reduction in the time domain amplitude in accordance with the maximum gradient will occur over a duration that is substantially equal with an expected periodicity in the time domain amplitude of the input sound signal.

18. A controller according to claim 17, wherein the predefined maximum gradient of the rate of the time domain amplitude reduction comprises between 20 $dBs^{-1}$ and 40 $dBs^{-1}$.

19. A non-transitory computer readable storage medium comprising computer readable instructions that, when executed by a computer, cause performance of the method claim 1.

* * * * *